United States Patent [19]

Champlin

[11] 4,234,081

[45] Nov. 18, 1980

[54] CARRIER FOR A PLURALITY OF ARTICLES

[75] Inventor: Charles L. Champlin, Rittman, Ohio

[73] Assignee: Packaging Corporation of America, Evanston, Ill.

[21] Appl. No.: 34,332

[22] Filed: Apr. 30, 1979

[51] Int. Cl.[3] ..... B65D 75/04; B65D 75/28

[52] U.S. Cl. ..... 206/147; 206/152; 206/168; 206/429; 229/28 BC; 229/52 BC

[58] Field of Search ..... 206/168, 140, 141, 194, 206/196, 193, 197, 158, 155, 156, 154, 152, 427, 429, 163, 161, 199, 147, 145, 157; 229/28 BC, 52 BC

[56] References Cited

U.S. PATENT DOCUMENTS

| | | | |
|---|---|---|---|
| 2,134,627 | 10/1938 | Turner . | |
| 2,314,895 | 3/1943 | Powell | 206/196 X |
| 2,339,176 | 1/1944 | Lee | 229/28 BC |
| 2,361,926 | 11/1944 | Brogden | 206/168 |
| 2,594,376 | 4/1952 | Arneson . | |
| 2,701,661 | 2/1955 | Murray . | |
| 2,731,170 | 1/1956 | Bergstein . | |
| 2,783,916 | 3/1957 | Hodapp . | |
| 2,877,894 | 3/1959 | Forrer . | |
| 3,016,182 | 1/1962 | Chidsey, Jr. . | |
| 3,066,795 | 12/1962 | Mansfield . | |
| 3,080,966 | 3/1963 | Kuchenbecker | 206/152 |
| 3,086,680 | 4/1963 | Graser . | |
| 3,096,906 | 7/1963 | Chidsey, Jr. et al. . | |
| 3,152,688 | 10/1964 | Mahon | 206/158 |
| 3,156,377 | 11/1964 | Wysocki | 206/196 X |
| 3,157,309 | 11/1964 | Chidsey, Jr. et al. | 206/155 |
| 3,167,214 | 1/1965 | Mahon . | |
| 3,175,684 | 3/1965 | Andre et al. . | |
| 3,176,902 | 4/1965 | Champlin | 206/158 X |
| 3,186,545 | 6/1965 | Conrades . | |
| 3,339,726 | 9/1967 | Moore . | |
| 3,356,283 | 12/1967 | Champlin . | |
| 3,386,570 | 10/1968 | Lock . | |
| 3,405,840 | 10/1968 | Chaplin | 206/168 |
| 3,429,496 | 2/1969 | Hickin . | |

*Primary Examiner*—Allan N. Shoap

*Attorney, Agent, or Firm*—Neuman, Williams, Anderson & Olson

[57] ABSTRACT

A carrier of foldable sheet material is provided for accommodating a plurality of necked articles arranged to form at least one row. The carrier includes a base panel which subtends and supports the accommodated articles. Extending upwardly from opposed first peripheral portions of the base panel are end panels which are disposed adjacent the end articles of a row. The upper edges of the end panels are interconnected by an elongated top panel which is disposed in spaced, substantially parallel superposed relation with respect to the base panel. Side panels extend upwardly from opposed second peripheral portions of the base panel. The side panels and end panels are interconnected and retained in upright angular relation with respect to one another. An elongated reinforcing member is foldably connected to the top panel and at least partially folded back under the top panel. The edge of the top panel to which the reinforcing member is foldably connected is provided with longitudinally spaced recesses for engaging the necked portions of the accommodated articles and coacting with the upright side panels to retain the articles within the carrier.

19 Claims, 28 Drawing Figures

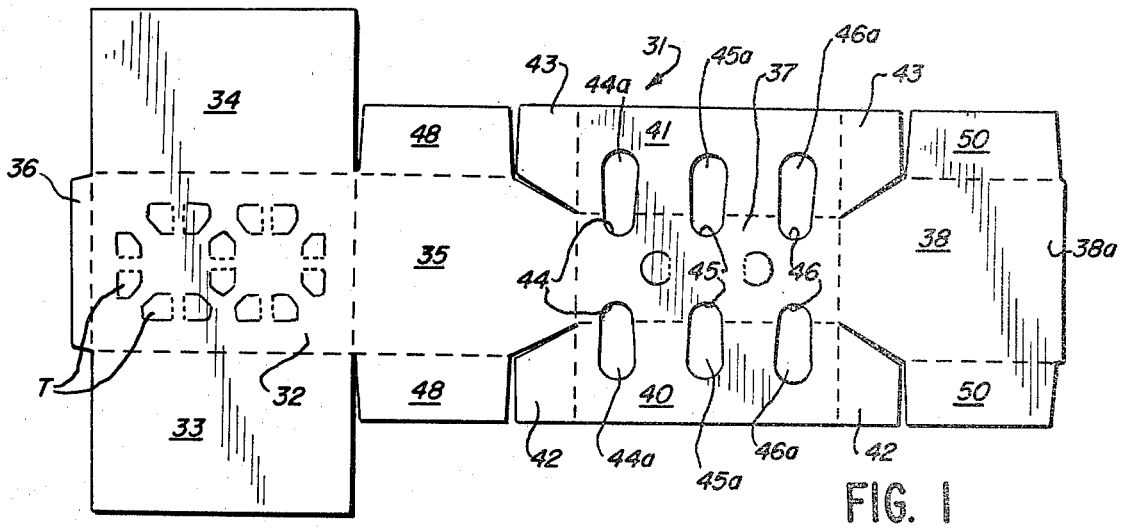
FIG. 1
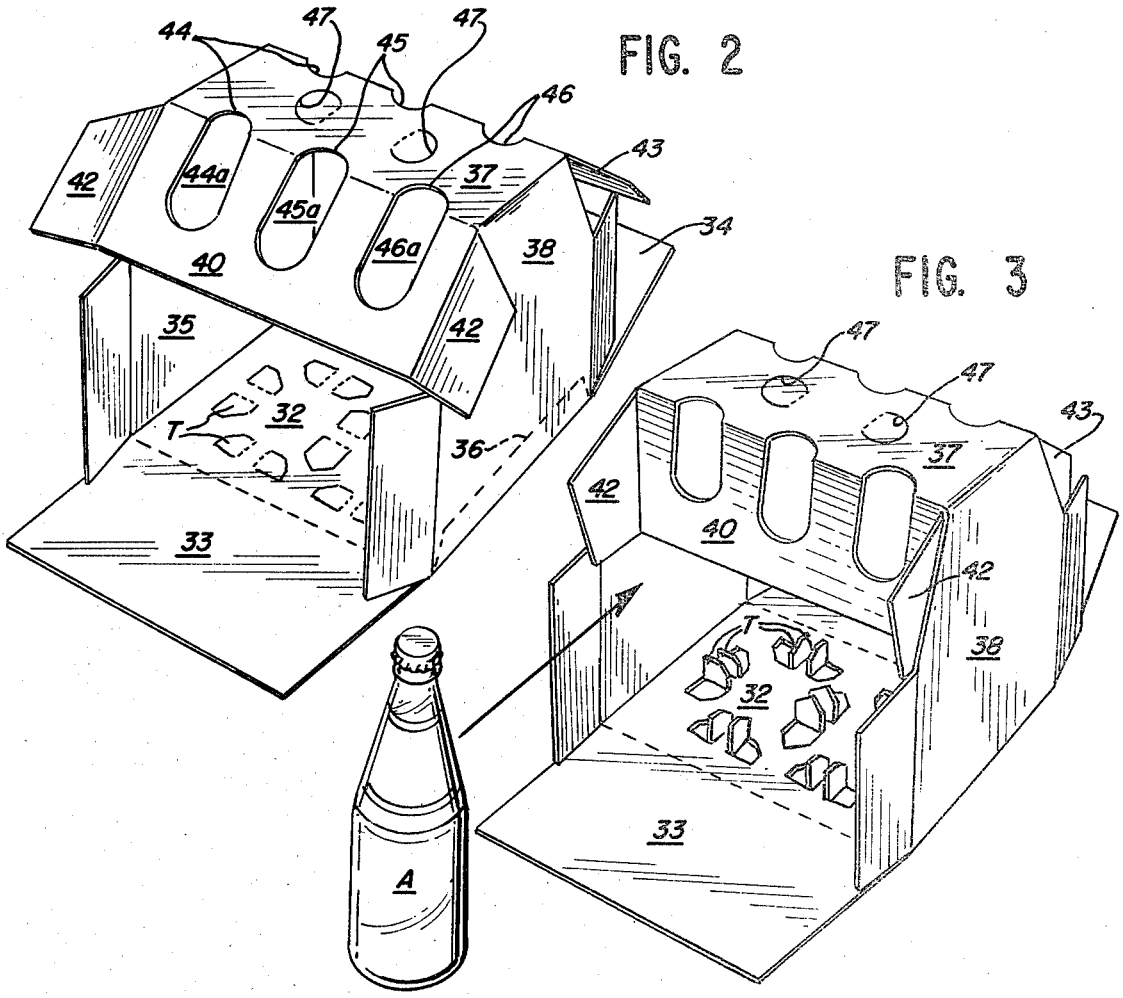
FIG. 2
FIG. 3

FIG. 4
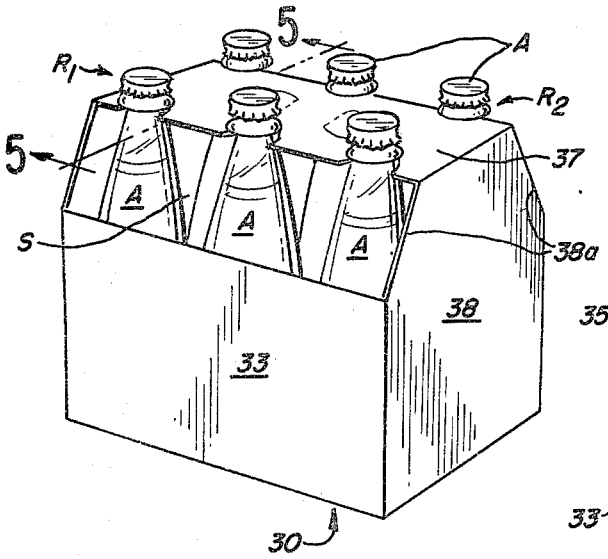
FIG. 5
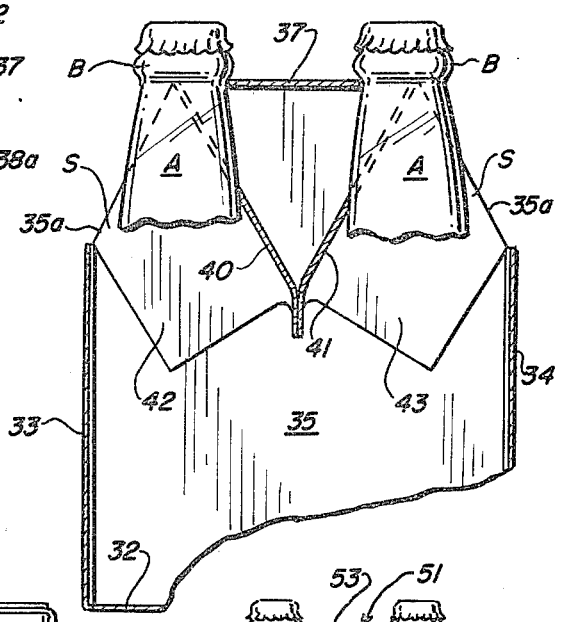
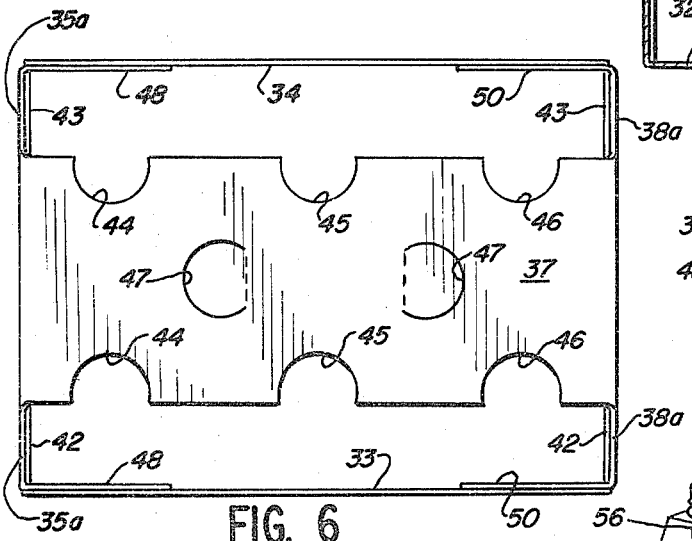
FIG. 6
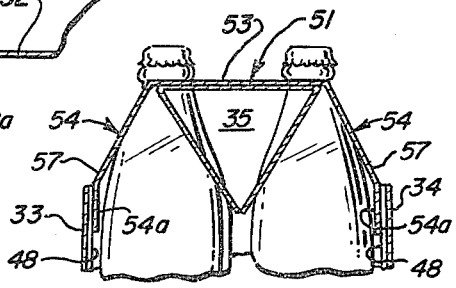
FIG. 8a
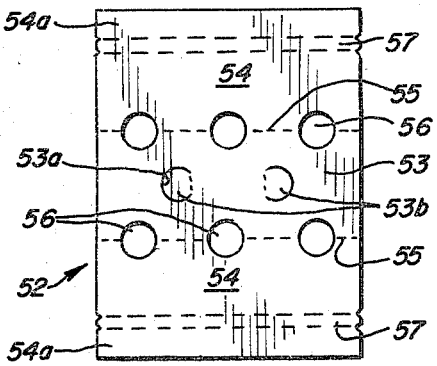
FIG. 7
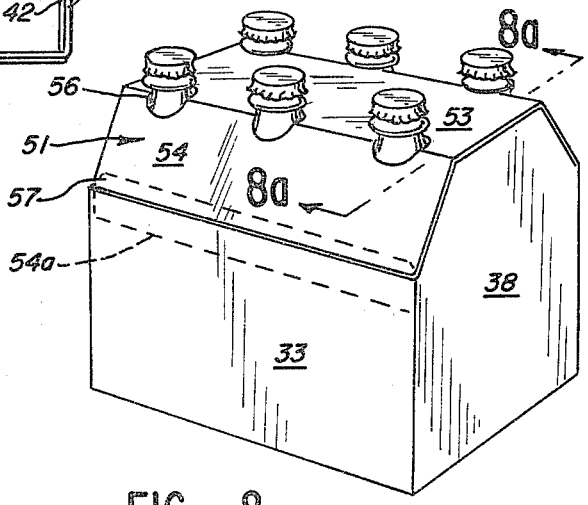
FIG. 8

FIG. 9
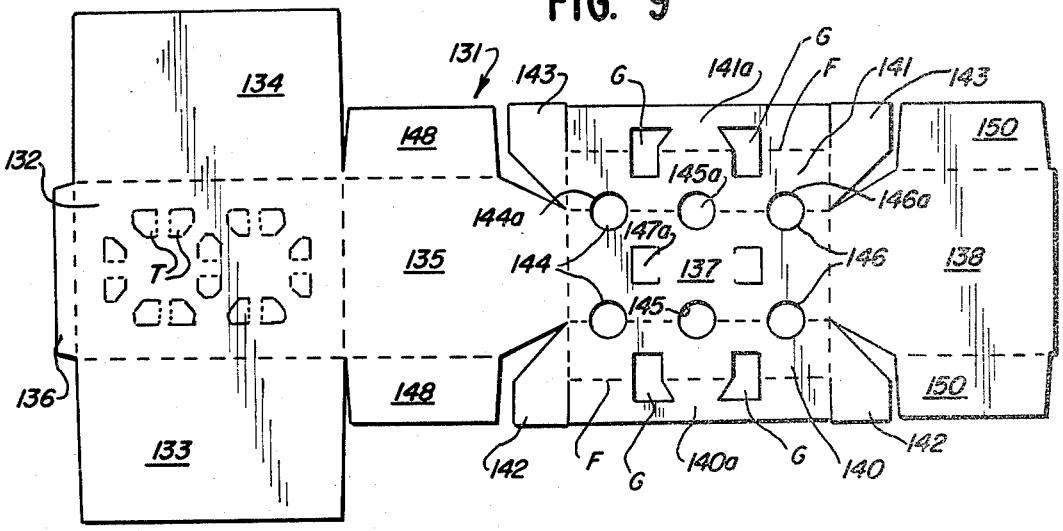
FIG. 10
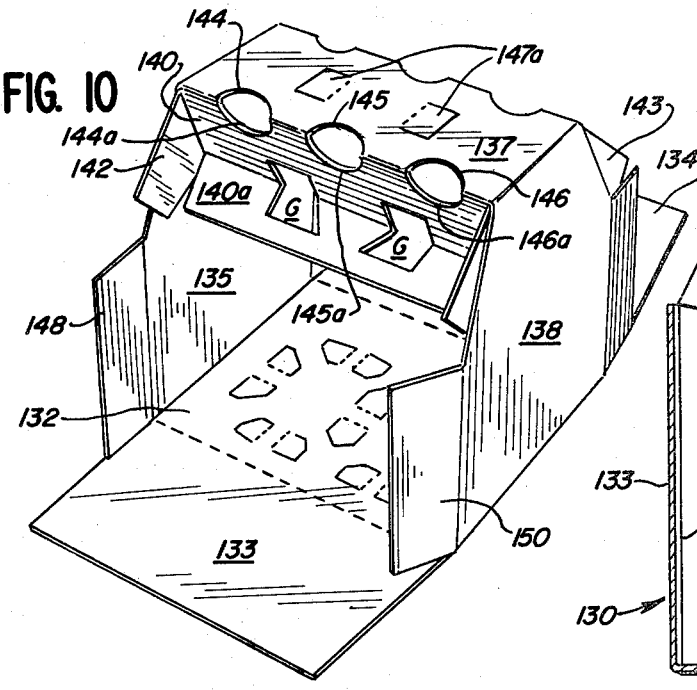
FIG. 11
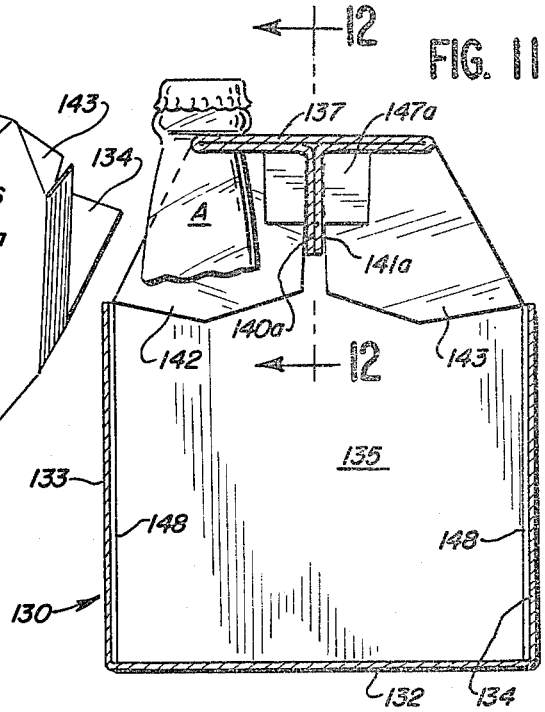
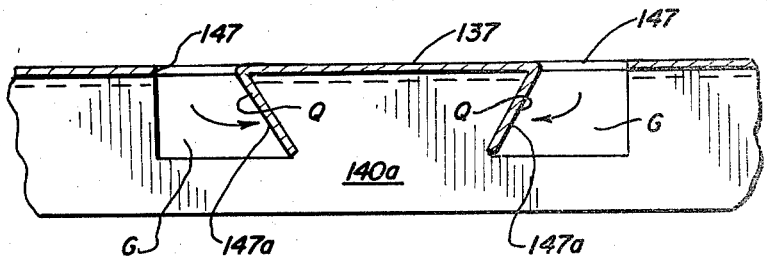
FIG. 12

FIG. 13
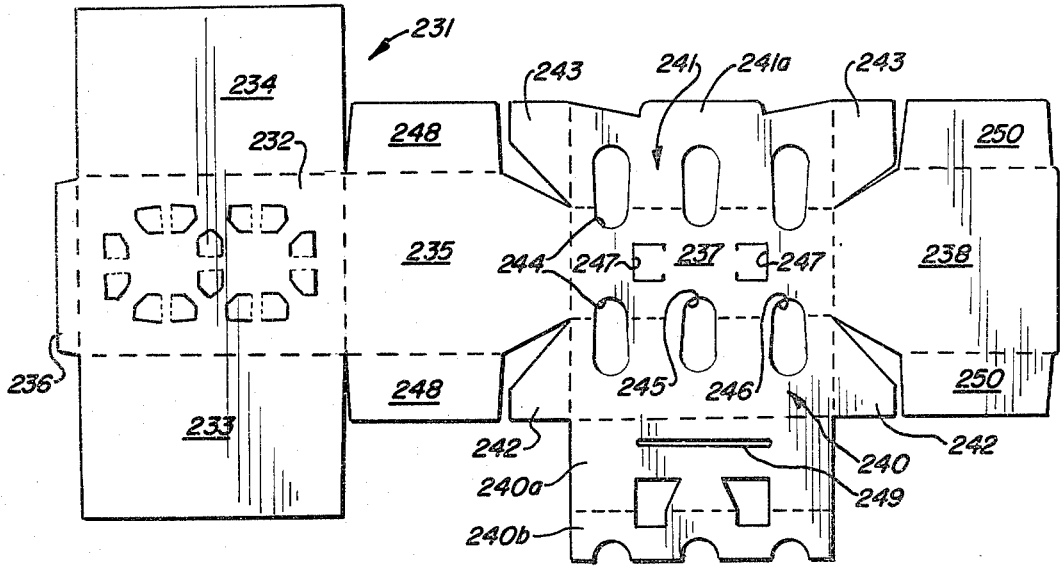
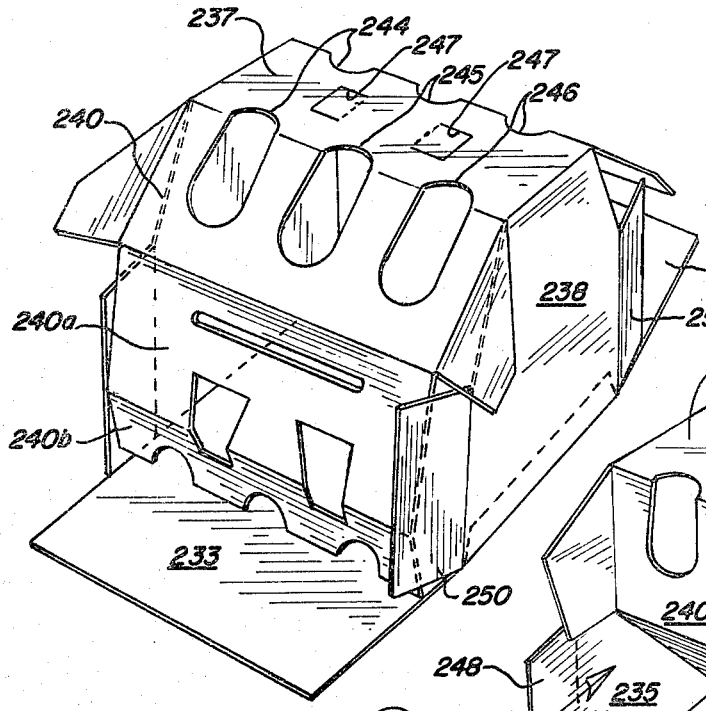
FIG. 14
FIG. 15
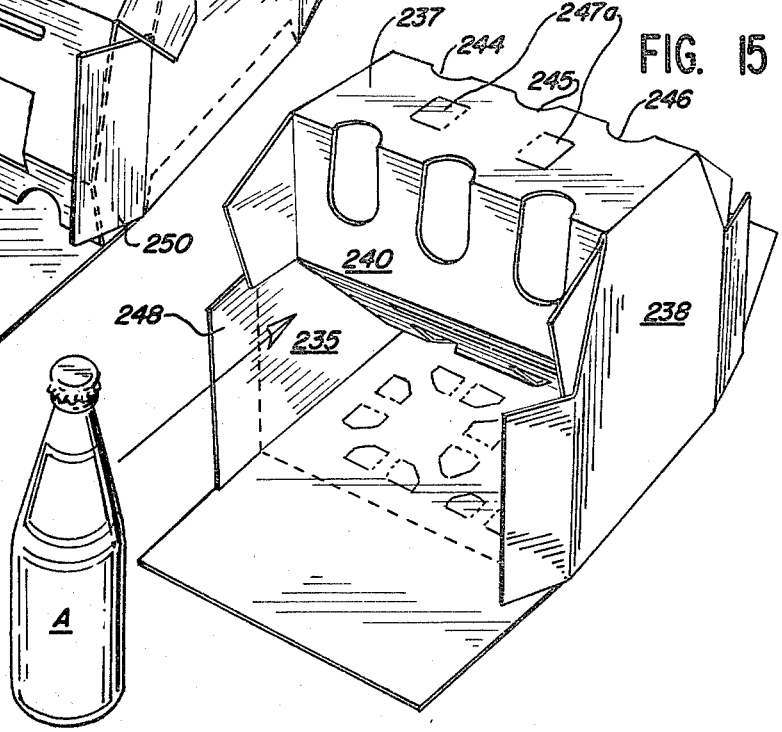

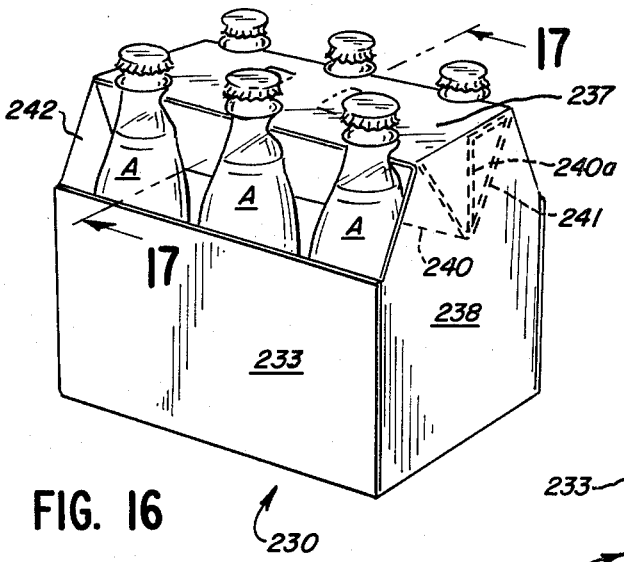
FIG. 16
FIG. 17
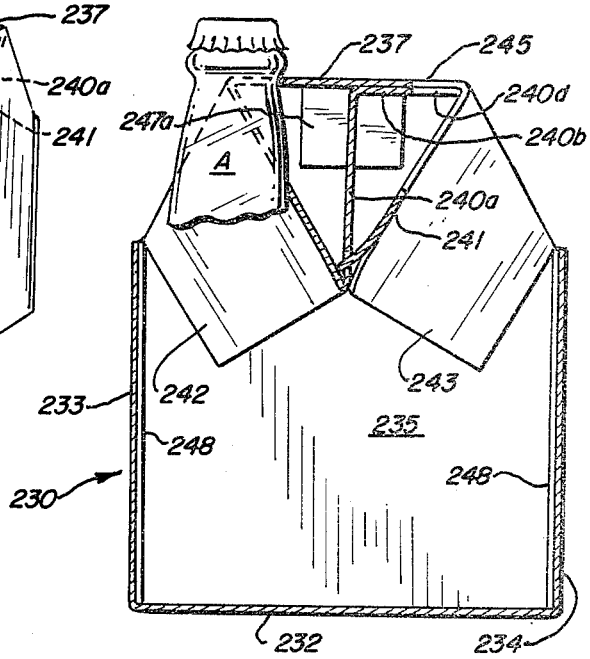
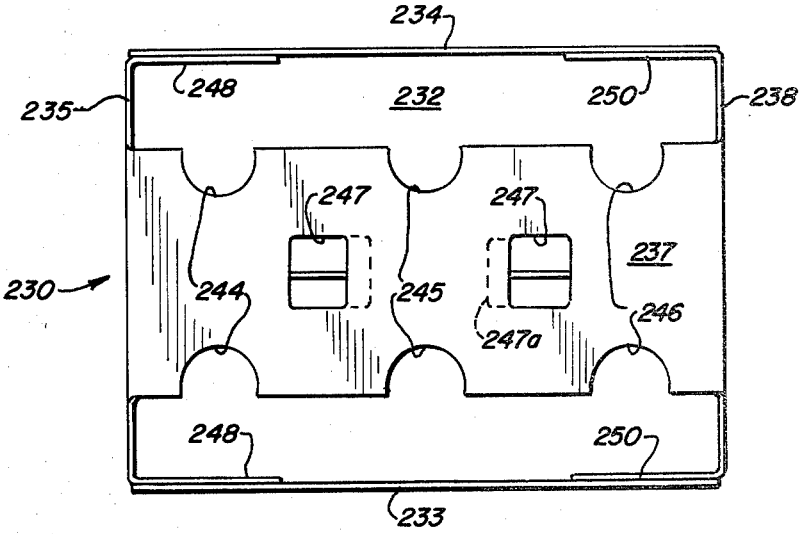
FIG. 18

FIG. 19
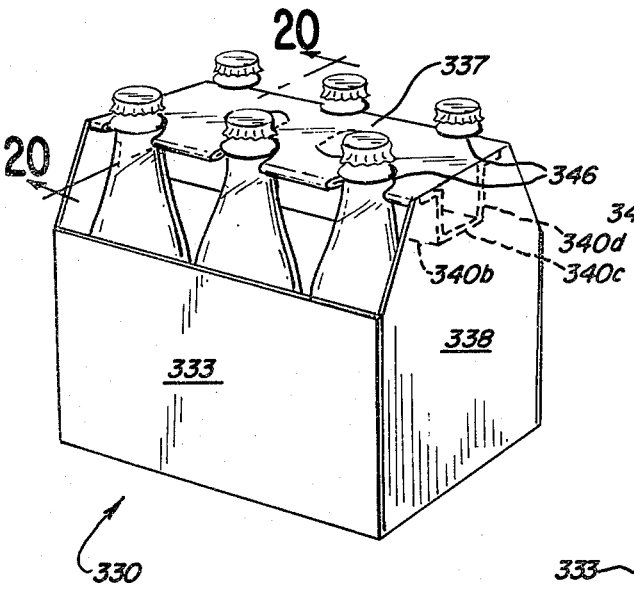
FIG. 20
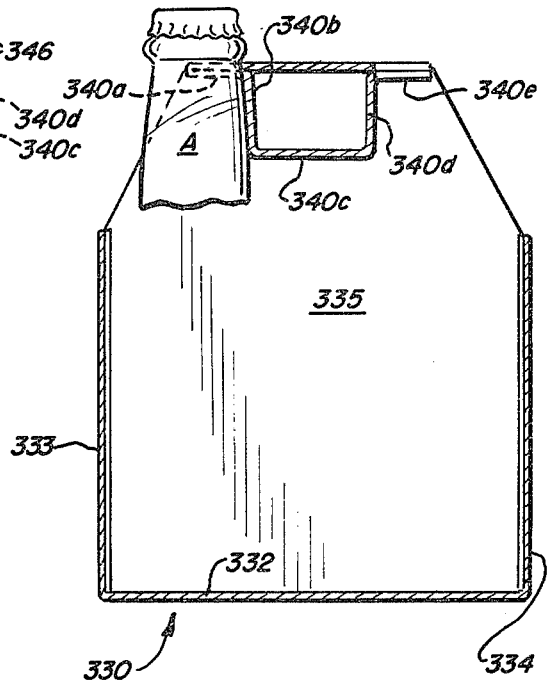
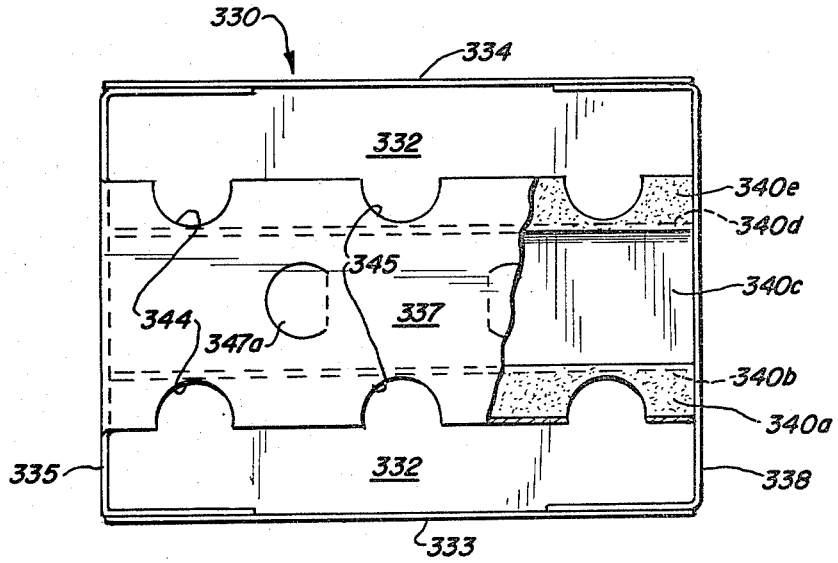
FIG. 21

FIG. 22
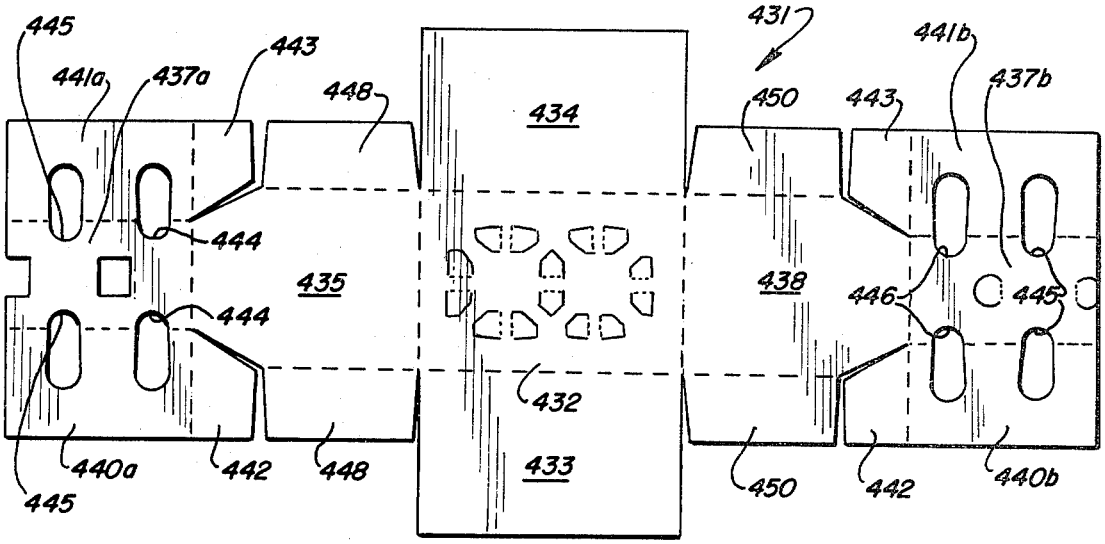
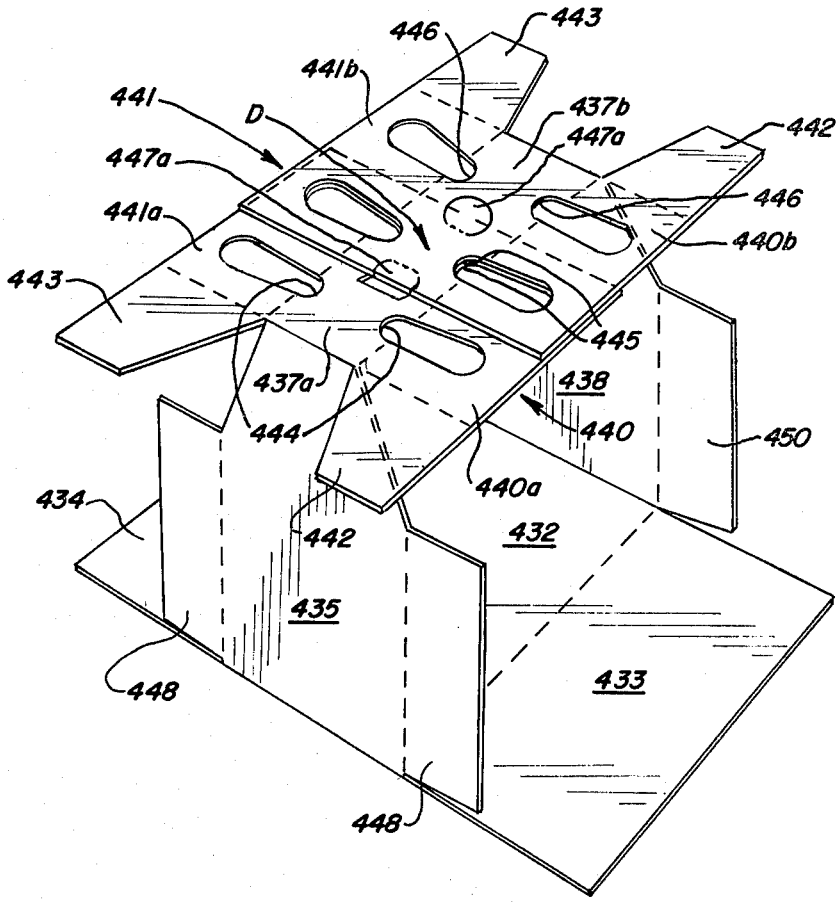
FIG. 23

FIG. 24
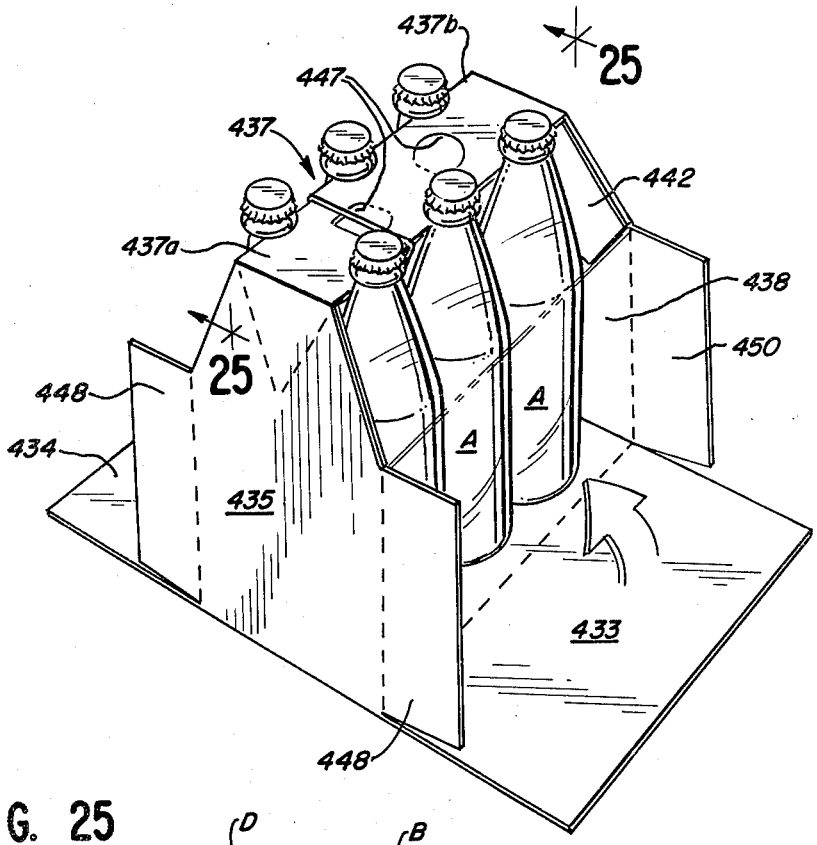
FIG. 25
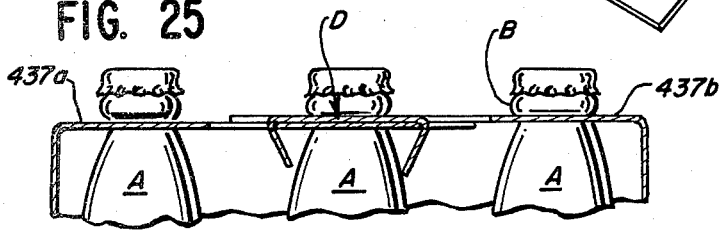
FIG. 27
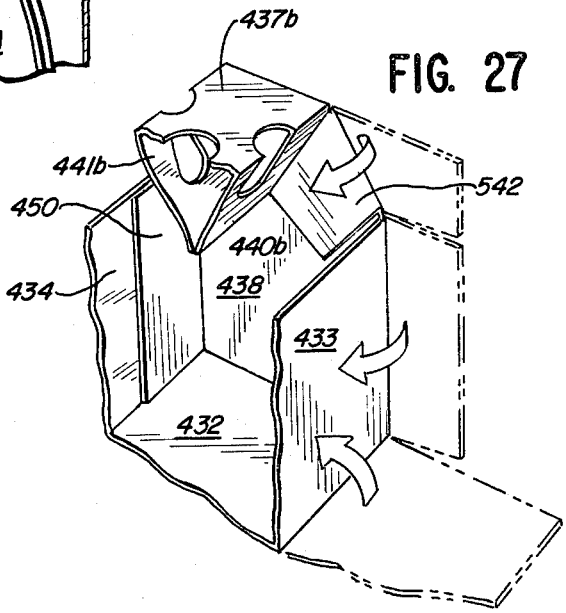
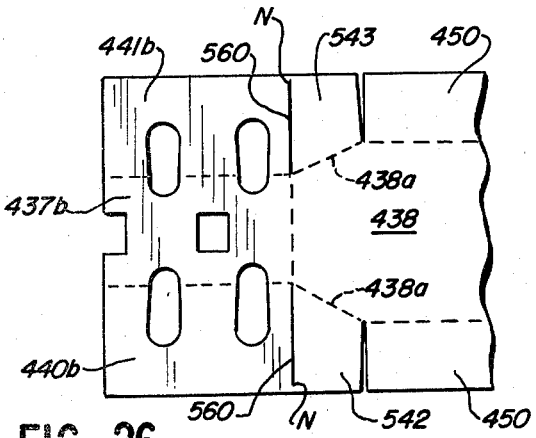
FIG. 26

CARRIER FOR A PLURALITY OF ARTICLES

BACKGROUND OF THE INVENTION

With the increased popularity of marketing various products (e.g., beverages) in returnable capped bottles and in quantities of four, six or eight, it is highly desirable that such bottles be packaged in carriers which are suitable for accommodating such bottles when filled and empty.

Various carriers for such purposes have heretofore been provided; however, because of certain inherent design characteristics, they are beset with one or more of the following shortcomings: (a) the carrier utilizes an inordinate amount of material; (b) the blank, or blanks, from which the carrier is formed are of complex configuration and difficult and awkward to set up to form the carrier; (c) the carrier is mutilated and seriously weakened when the articles are initially removed from the carrier; (d) the articles are susceptible to falling out or being accidentally removed from the carrier when the latter is being subjected to normal handling; (e) portions of the carrier become severely distorted when the loaded carrier is being manually carried, thereby rendering the carrier unstable and awkward to carry; and (f) the carrier is difficult to load with high-speed equipment.

SUMMARY OF THE INVENTION

Thus, it is an object of the invention to provide a carrier of the type described which readily avoids the shortcomings associated with prior carriers.

It is a further object of the invention to provide a carrier of the type described having a blank which is readily formed by conventional, high-speed blanking apparatus.

It is a further object of the invention to provide a carrier of the type described which may be set up and loaded with automatic high-speed packaging equipment.

It is a still further object of the invention to provide a carrier of the type described which is capable of accommodating articles having a configuration and size varying over a wide range.

It is a still further object of the invention to provide a carrier which is of simple, yet sturdy, construction, is attractive in appearance and provides effective protection for the accommodated articles.

Further and additional objects will appear from the description, accompanying drawings and appended claims.

In accordance with one embodiment of the invention a carrier is provided for accommodating a plurality of necked articles arranged to form at least one row. The carrier is formed of sheet material and includes a base panel which subtends and supports the row of articles. Extending upwardly from opposed first peripheral portions of the base panel are end panels, each being disposed adjacent an end article of the row. The upper edges of the end panels are interconnected by an elongated top panel having an elongated peripheral edge provided with longitudinally spaced recesses for engaging the necked portions of the accommodated articles. Foldably connected to the elongated peripheral edge of the top panel is a reinforcing member which is at least partially folded back under the top panel. Extending upwardly from opposed second peripheral portions of the base panel are side panels, the upper edges of which are spaced downwardly and outwardly from the elongated edges of the top panel. The top panel, base panel, end panels and side panels coact with one another to retain the accommodated articles within the carrier.

DESCRIPTION

For a more complete understanding of the invention reference should be made to the drawings wherein:

FIG. 1 is a top plan view of a blank for one form of the improved carrier.

FIGS. 2 and 3 are perspective end views showing successive stages of setting up the blank of FIG. 1; FIG. 3 shows the direction of movement of an article relative to the partially set up blank to effect loading of the carrier.

FIG. 4 is a perspective end view of the loaded carrier formed from the blank of FIG. 1.

FIG. 5 is an enlarged fragmentary sectional view taken along line 5—5 of FIG. 4.

FIG. 6 is an enlarged top plan view of the carrier of FIG. 4 but with the articles removed therefrom.

FIG. 7 is a top plan view of a blank of one form of an optional support member which is adapted to be used in combination with the loaded carrier of FIG. 4 to provide light shield for the accommodated articles.

FIG. 8 is similar to FIG. 4 but showing the support member assembled on the carrier of FIG. 4.

FIG. 8*a* is a fragmentary sectional view taken along line 8*a*—8*a* of FIG. 8.

FIG. 9 is similar to FIG. 1 but showing a blank for a second form of the improved carrier.

FIG. 10 is a perspective end view of the blank of FIG. 9 during one stage of being set up.

FIG. 11 is similar to FIG. 5 but of the second form of the improved carrier.

FIG. 12 is an enlarged fragmentary sectional view taken along line 12—12 of FIG. 11 but with the articles removed from the carrier.

FIG. 13 is similar to FIGS. 1 and 9 but showing a blank for a third form of the improved carrier.

FIGS. 14 and 15 are similar to FIGS. 2 and 3 and show the blank of FIG. 13 in successive stages of set up.

FIG. 16 is a perspective end view of the loaded improved carrier formed from the blank of FIG. 13.

FIG. 17 is an enlarged fragmentary sectional view taken along line 17—17 of FIG. 16.

FIG. 18 is an enlarged top plan view of the carrier of FIG. 16 but with the articles removed therefrom.

FIG. 19 is a perspective end view of a fourth form of the improved carrier shown fully loaded.

FIG. 20 is an enlarged fragmentary sectional view taken along line 20—20 of FIG. 19.

FIG. 21 is an enlarged top plan view of the improved carrier of FIG. 19 without articles and with a part of the top panel removed so as to reveal the reinforcing member.

FIG. 22 is similar to FIGS. 1, 9 and 13, but showing a blank for a fifth form of the improved carrier.

FIGS. 23 and 24 are perspective end views showing the blank of FIG. 22 in successive stages of set up; FIG. 24 shows the articles being loaded into the partially set up carrier.

FIG. 25 is an enlarged fragmentary sectional view taken along line 25—25 of FIG. 24.

FIG. 26 is a fragmentary top plan view of one of the top panel-forming sections of the blank of FIG. 22 but with a slight modification thereto.

FIG. 27 is a fragmentary perspective vertical sectional view of the modified blank of FIG. 26 being set up but without the articles in place.

Referring now to the drawings and more particularly to FIG. 4, one form 30 of the improved carrier is shown which is adapted to readily carry a plurality of articles A arranged preferably in two parallel rows $R_1$, $R_2$ of three articles each. The articles A utilized in describing hereinafter the various forms of carriers, are conventional necked type bottles having either a screw or clinched (crown) style cap. The bottles are extensively utilized in the beverage industry.

Because of the ecological concerns prevalent today throughout many geographical areas of the world the use of returnable bottles is rapidly surplanting that of nonreturnable bottles and cans. Accordingly because of this fact, it is important that the carrier be of such design that it can readily accommodate full and empty articles.

All of the carriers to be hereinafter described are preferably formed from a blank of foldable sheet material (e.g., paperboard). The blank 31 for carrier 30 is shown in FIG. 1 and may be readily formed on conventional high-speed blanking equipment. Blank 31, when set up, forms a carrier 30 which is intended to accommodate simultaneously six articles A in two rows $R_1$, $R_2$. It should be understood, of course, that the invention hereinafter described is not intended to be limited to such a design. For example, the improved carrier might accommodate four, six, eight or more articles arranged in one or two rows. The most popular size carrier is one that accommodates six articles in two rows and it is for this reason that the improved carriers to be herein described will be of this size.

Blank 31 includes a rectangular base panel 32 which is adapted to subtend and support the accommodated articles. The base panel is provided with a plurality of push up tabs T which serve to separate the bottom portions of adjacent articles and thereby prevent contact or checking between adjacent bottom portions when the carrier is being subjected to normal handling. Foldably connected to the opposed elongated side edges of panel 32 are a pair of side panels 33, 34. Foldable connected to the remaining two edges of panel 32 are an end panel 35 and a manufacturer's glue flap 36. The end panel extends upwardly from the base panel and is disposed adjacent corresponding end articles of the two rows $R_1$, $R_2$.

Foldably connected to the edge of end panel 35, which will become an upper edge when the carrier is formed, is one end of an elongated top panel 37. Panel 37 is relatively narrow as compared to base panel 32 for reasons to be hereinafter explained. The opposite end of panel 37 is foldably connected to a second end panel 38. End panels 35, 38 are of like configuration and, when the carrier is formed, are disposed in spaced substantially parallel relation. The length of top panel 37 is substantially coextensive with the lengths of the article rows $R_1$, $R_2$. The bottom edge portion 38*a* of end panel 38 is adapted to be adhesively attached to the manufacturer's glue flap 36, thereby permitting the blank 31 to subsequently assume a squared-up configuration, see FIGS. 2 and 3, so as to simultaneously receive the rows of articles through the open sides of the carrier during the loading operation.

Foldably connected to the opposite elongated peripheral portions of the top panel 37 are reinforcing members 40, 41 which are of like rectangular configuration. Foldably connected to the opposite ends of each member 40, 41 are flaps 42, 43, respectively. The foldline connections between the reinforcing members and the top panel are interrupted by longitudinally spaced recesses 44, 45, 46. The shape of each recess is such that it will snugly engage the neck of an article A below a collar B normally formed in the neck of the article beneath the cap therefor.

Each reinforcing member 40, 41 is provided with an open end slot or recess 44*a*, 45*a*, 46*a* which is aligned with a corresponding recess formed in the edge of the top panel 37.

Disposed along the longitudinal centerline of the top panel 37 is a pair of conventional finger holes 47 which facilitate carrying of the carrier when it is loaded with articles A. Because of the recesses 44–46 accommodating the necks of the articles beneath the collars B thereof, outward bowing of the top panel 37 is restrained and insignificant when the finger holes 47 are being used for manually carrying a loaded carrier. Thus, the stability of the loaded carrier while being manually carried is significantly improved.

As seen in FIG. 1, tuck flaps 48 and 50 are connected to opposing peripheral portions of end panels 35, 38, respectively. When the carrier is formed the flaps 48, 50 are folded at approximately right angles to the end panels 35, 38 and are adhesively secured to the adjacent end portions of the side panels 33, 34 and retain the latter in their upright, angular positions relative to the end panels.

When the carrier is formed, the upper edges 33*a*, 34*a* of the side panels 33, 34 are spaced downwardly and outwardly relative the elongated peripheral portions of the top panel 37. Thus, open side spaces S are formed in the carrier which enable the individual articles to be removed from the carrier when the article is tilted outwardly so that the necked portion of article clears the recess in the top panel 37. Once the necked portion is clear of the top panel recess, the tilted article can be pulled upwardly and outwardly through the space without causing mutilation of the carrier.

As seen in FIGS. 2 and 3, when the carrier is to be initially loaded, the partially set up blank is squared up so that the end panels 35, 38 are in substantially parallel relation and the side panels 33, 34 are in coplanar relation with the base panel 32, see FIG. 2. The reinforcing members 40, 41 are then folded downwardly relative to the top panel 37, so that the members are in substantially parallel relation and disposed between the end panels 35, 38, see FIG. 3. When the members 40, 41 assume such positions the end flaps 42, 43 connected to opposite ends of the members assume substantially right angles to the members and are also disposed between the end panels 35, 38. The end flaps extend outwardly from the reinforcing members because of the camming action effected by peripheral portions 35*a*, 38*a* of the end panels which engage the backsides of the end flaps when the reinforcing members are folded downwardly.

The tabs T formed in the base panel are pushed upwardly so that when the articles are in place within the carrier, the tabs will serve to space apart the bottom portions of adjacent articles in a row, as well as corresponding articles in the two rows. When the partially set up carrier assumes the position shown in FIG. 3, each row of articles is simultaneously moved as a unit towards one another through the open sides and spotted on the base panel 32. Movement of the rows of articles, as described, can be readily accomplished by conventional high-speed loading equipment. Also, the folding and squaring up of blank 31 can also be accomplished by conventional high-speed folding equipment.

As the rows of articles are being moved into position on the base panel 32, the upper portions of the articles will engage the lower portions of the depending reinforcing members 40, 41 and will cause the latter to be folded back under the top panel 37, see FIG. 5. Simultaneously with the folding back of the reinforcing members, the necked portions of the articles will move into the aligned recesses 44, 45, 46 formed along the periphery of the top panel 37. The height of the top panel 37 relative to the base panel 32 is such that the collars B formed on the necked portions of the articles will slidably engage the exposed surface of the top panel portions circumjacent the recesses.

As seen in FIG. 5, the reinforcing members 40, 41 have the lower edges thereof in substantial contact with one another. Thus, the reinforcing members and the top panel coact with one another to form a hollow strut having a substantially triangular cross-sectional configuration which spans the distance between the end panels 35, 38. When the reinforcing members are in such strut-forming positions, the end flaps 42, 43 are in face-to-face contact with the interior surfaces of the end panels and produce a shadow box effect which can be observed through the spaces S formed between the upper edges of the side panels and the elongated peripheral portions of the top panel. Because the sheet material (e.g., paperboard) utilized for the carrier is normally finished and printed on only one surface thereof, the shadow box effect produced by the exposed finished surfaces of the end flaps 42, 43 enhances the esthetic appearance of the carrier.

In instances where the contents of the articles (bottles) are deleteriously affected by light rays, it may be necessary to initially cover over the spaces S and thus shield the accommodated articles from such rays. To accomplish this result and at the same time provide added support for the top panel, a support member 51 may be utilized which is formed from a blank 52 of sheet material (e.g., paperboard), see FIG. 7. Blank 52 includes a rectangular center section 53 which overlies and is coincident with the top panel 37 of the carrier, when the support member is assembled therewith. Foldably connected to opposite sides of center section 53 are side shield sections 54. The foldlines 55 connecting sections 53, 54 are interrupted by longitudinally spaced openings 56. The openings 56 are sized so that the capped ends, including the collars B of the articles (bottles) will readily pass therethrough, see FIG. 8. The center section 53 is provided with a pair of finger holes **53*a* which are aligned with the holes 47 formed in the underlying top panel 37. The outer edge portions 54*a* of the side shield sections 54 are foldable relative to the remainder of the sections and, when the support member 51 is assembled on the carrier the edge portions 54*a* are adhesively connected to either the outer surfaces of the upper edge portions of the carrier side panels 33, 34 or to the inner surfaces of the tuck flaps 48, 50**. Besides shielding the accommodated articles from harmful light rays, the support member provides a straplike reinforcement for the carrier top panel.

To facilitate removing the articles from the carrier when the support member 51 is in place, tear strips 57 may be provided on the side shield sections 54 which can be manually removed, when desired, and thus allow the remainder of the exposed support member to be removed from the top panel 37.

When the tabs **53*b* formed in the center section 53 of the support member 51 are pushed downwardly so as to allow a finger to pass through each resulting hole 53*a*, the depending tabs 53*b* will pass through the aligned holes 47 in the top panel 37 and thus lock the center section 53 in superposed relation with the top panel 37** disposed therebeneath.

FIG. 11 illustrates a second embodiment 130 of the improved carrier. To facilitate understanding of the similarities between carrier 30 and carrier 130, the corresponding components of the latter will be given the same identifying number as carrier 30 but in a one hundred series. The principal structure differences between carrier 30, 130 can be readily ascertained from observing the blanks 31 (FIG. 1) and 131 (FIG. 9) and more particularly the top panel 37, 137 and reinforcing members 40, 41 and 140, 141 associated therewith.

The top panel 137 is of substantially the same rectangular configuration as top panel 37 and is provided with peripheral recesses 144, 145, 146 for accommodating the necked portions of the articles A. The reinforcing members 140, 141, which are foldably connected to the opposed elongated peripheral sides of the top panel 137, are each provided with a reverse folding scoreline F which is in spaced parallel relation with the folding connection between the top panel and the reinforcing member. The distance between the scoreline F and the elongated peripheral edge of the top panel is approximately one half the width of the top panel. As will be noted in FIG. 9, each scoreline F is interrupted by a pair of longitudinally spaced apertures G. The apertures are transversely aligned with the finger holes 147 formed in the top panel 137. As will be observed, a portion of each aperture extends into the adjacent free edge portion **140*a*, 141*a* of the reinforcing member. Each reinforcing member is provided with a recess 144*a*, 145*a*, 146*a* which communicates and is aligned with the recesses 144, 145, 146** formed in the top panel thereby facilitating positioning of the article necked portions in the recesses.

As seen in FIG. 11, when the blank is set up to form carrier 130 and the latter is loaded with the articles, the reinforcing members are folded back under top panel 137 and the free edge portions **140*a*, 141*a* of the reinforcing members are in substantially face-to-face contact and extend downwardly from the underside of the top panel. The tabs 147*a*, which are aligned with the finger holes 147 formed in the top panel, are manually pushed down into the corresponding portions of the apertures G formed in the depending portions 140*a*, 141*a* of the reinforcing members when the fingers are inserted into the holes 147 for carrying the loaded carrier 130. When the inserted fingers grip the carrier, the tabs 147*a* will abut the slanted perimetric segments Q of the apertures G and interlock with the latter and thus cause the reinforcing members 140, 141 to form a regid T-shaped strut disposed beneath the top panel 137 and between the end panels 135, 138**. The strut significantly increases the stiffness of the top panel when the loaded carrier is being manually carried.

If desired, the portions of the reinforcing members 140, 141 which are in face-to-face relation with the underside of the top panel 137 may be adhesively secured thereto. It has been found, however, in most instances when the finger hole tabs **147*a* are pushed into the apertures G, that the reinforcing members will assume and remain in the fold back positions, as shown in FIG. 11** without the need for adhesive.

FIGS. 16–18 show a third embodiment 230 of the improved carrier and as in the case of carrier 130, the corresponding components of carrier 230 will be identified by the same numbers as in carrier 130 but in the two hundred series. The structural differences between carriers 130 and 230 lies primarily in the configuration of the reinforcing member 240, 241 and their interrelation to one another when the blank 231 is fully set up to form the carrier 230.

In blank 231, shown in FIG. 13, reinforcing members 240, 241 are foldably connected to the opposite elongated peripheral portions of the top panel 237 as was the case with the previously described blanks 31, 131. The outer free edge of member 241 (said edge being the lower edge of the member when the blank is fully set up) is provided with a tonguelike projection 241*a*, the purpose of which will become apparent from the discussion to follow hereinafter.

Foldably connected to the outer edge of reinforcing member 240 is a first section 240*a* which is adapted to assume a substantially perpendicular depending position with respect to the underside of the top panel 237 when the carrier is formed, see FIG. 17. Foldably connected to the opposite edge of first section 240*a* is a second section 240*b* which is adapted to assume a face-to-face contact with approximately one half the underside of top panel 237. The elongated free edge of second section 240*b* is provided with longitudinally spaced recesses 240*c*, 240*d*, 240*e*. When the carrier 230 is formed the second section recesses are aligned with the corresponding recesses 244, 245, 246 provided in one elongated peripheral portion of top panel 237.

Formed in first section 240*a* and disposed adjacent to, but spaced from, the folding connection between the reinforcing member 240 and the first section is an elongated slot 249. The slot is adapted to be lockingly engaged by the projection 241*a* when the reinforcing members 240, 241 are folded back under the top panel 237. In order to effect interlocking between the slot and projection, the sequence of folding the reinforcing members 240, 241 relative to the top panel 237 is different in certain respects from the folding sequences followed with respect to blanks 31, 131. With blank 231, it is necessary, when reinforcing member 240 is folded downwardly relative to the top panel 237, that the first and second sections 240*a*, 240*b* be folded relative to the reinforcing member 240 so they will assume the positions shown in FIG. 17. The foldline connection between the first and second sections is a reverse folding scoreline, thus facilitating the second section assuming a right angle position with respect to the first section. When reinforcing member 241 assumes the acute angular position with respect to the underside of the top panel 237, as seen in FIG. 17, the second section 240*b* will be held against the underside of the top panel 237.

When the reinforcing member 241 is being moved to the position shown in FIG. 17, the member is folded inwardly to a slightly greater degree than shown so that the tongue-like projection 241*a* formed on the lower edge of member 241 will automatically move through the slot 249 and cause the reinforcing members 240, 241 to be interlocked in their folded positions. When the reinforcing members are interlocked with one another, a hollow strut having a substantially triangular cross-sectional configuration is formed which extends between the end panels 235, 238. Besides the triangular cross-sectional configuration, the stiffness of the strut is enhanced by the vertical disposition of the first section 240*a* of reinforcing member 240. The first section is also retained in its vertical disposition by the finger hole tabs 247*a* which extend into and interlock with the portion of the apertures G formed in the first section 240*a* of the reinforcing member 240. The interlocking relation between the tabs 247*a* and the apertures G is like that shown in FIG. 12.

A forth form of the improved carrier 330 is shown in FIGS. 19–21 which is adapted to readily accommodate two rows of articles. Carrier 330 differs from carrier 230 in the configuration of the hollow strut which is disposed beneath the top panel 337 and intermediate the end panels 335, 338. The strut in carrier 330 is formed of a single reinforcing member 340 which is foldably connected to one elongated peripheral portion of top panel 337. Member 340 includes five foldably connected sections 340*a*, 340*b*, 340*c*, 340*d*, 340*e*. The strut is formed prior to the articles being disposed within the carrier and, thus, does not rely on the articles to form the ultimate strut. When the strut is formed, sections 340*a* and 340*e* are adhesively attached to the underside of the top panel 337, see FIG. 20. Sections 340*b–d* coact to form a substantially channel-shaped unit which is centrally aligned with respect to the top panel. In the illustrated embodiment the transverse dimension of the U-shaped unit as determined by section 340*c* is such that when the rows of articles are disposed within the carrier 330, the necked portions of the articles of one row will engage one side of the strut and the necked portions of the articles of the other row will engage the opposite side of the strut, as seen in FIG. 20.

The opposed elongated peripheral portions of top panel 337 are provided with longitudinally spaced recesses 344, 345, 346. Both sections 340*a*, 340*e* are provided with corresponding recesses so as to enable the necked portions of the accommodated articles to be readily positioned within the recesses of the top panel and underlying reinforcing member sections.

The spacing between reinforcing member section 340*c* and the underside of the top panel enables the finger hole tabs 347*a* in the top panel to be readily pushed downwardly by fingers when the latter are being inserted through the finger holes 347 to effect manual carrying of the loaded carrier 330.

FIGS. 22–25 disclose another form of carrier 430 and blank 431 therefor which has a top panel 437 with portions thereof of increased thickness. The increased thickness is attained by reason of overlapping sections 437*a*, 437*b* which form components of the top panel. The overlying sections are adhesively secured to one another and thus eliminate the need for the conventional manufacturer's glue flap included in the blanks 31, 131, 231 previously described.

As seen in FIG. 22, blank 431 includes a rectangular base panel 432 and a pair of end panels 435, 438 disposed on opposite sides of panel 432 and having the bottom edges thereof foldably connected to the narrow peripheral segments of panel 432. Foldably connected to opposite, or upper, edges of the end panels 435, 438 are top panel sections 437*a*, 437*b*, respectively. When the blank 431 is squared up, as seen in FIGS. 23, 24, top panel section 437*b* will partially overlap and be adhesively secured to section 437*a*. The overlapping portions of the sections 437*a*, 437*b*, as seen in FIGS. 23–25 occur in the area D located substantially between the finger holes 447 provided in the top panel 437. Rather than having the sections in partially overlapping relation as illustrated, the sections may be of such size and shape that they are in fully overlapping relation—that is to say, each section spans the distance between the upright end panels 435, 438. If desired, however, from an esthetic standpoint the length of overlapping section 437*b* may only be such that it spans the distance between the end panels while section 347*a* may have a shorter length, such, for example, as seen in FIG. 22.

In the illustrated embodiment, top panel section 437*b* partially overlaps section 437*a* and the tabs 447*a* associated with the finger holes 447 are provided on section 437*b* so that when the tabs are pushed downwardly they will extend through suitable apertures 447*b* formed in the underlying section 437*a*. The increased thickness of area D provides greater strength against tearing of the top panel when such area is grasped between the fingers inserted into the holes 447.

It will also be noted in FIG. 22 that blank 431 has reinforcing member sections 440*a* and 441*a* foldably connected to opposite sides of top panel section 437*a*, and similar sections 440*b*, 441*b* foldably connected to opposite sides of top panel section 437*b*. When the blank 431 is squared up, reinforcing member sections 440*b*, 441*b* will partially overlap and, preferably, be adhesively secured to corresponding sections 440*a*, 441*a* which are connected to top panel section 437*a*.

As in the other carriers 30, 130, 230, 330, the opposite elongated peripheral portions of the top panel 437 in carrier 430 are provided with longitudinally spaced recesses 444, 445, 446. However, because top panel 437 is formed of partially overlapping sections 437*a*, 437*b*, each section is provided with only two of the three recesses included on each elongated peripheral portion of the top panel. As seen in FIG. 22, top panel section 437*a* includes recesses 444 and 445 and top panel section 437*b* includes recesses 445 and 446. The corresponding recesses 445 in the two panel sections are in alignment with one another, as seen in FIG. 23. Except for the top panel 437 and reinforcing members 440, 441 being formed by at least partially overlapping sections, they function and are folded relative to one another in the same way as described with respect to the top panel and reinforcing members of carrier 30.

It will be noted in both carriers 330 and 430 that the components thereof which correspond to similar components of carrier 30 have been given the same identifying members, but, respectively, in the three hundred and four hundred series.

All of the carriers heretofore described, except carrier 330, have embodied reinforcing members in which end flaps have been foldably connected to opposite ends thereof so as to produce a shadow box effect in the resulting carrier. In FIGS. 26, 27, however, such end flaps 542, 543 are shown as being foldably connected to the end panels rather than to the ends of the reinforcing members. To facilitate understanding this structural change, the flaps 542, 543 are shown in FIGS. 26, 27 attached to the end panel 438 of carrier 430. It is to be understood, however, that the structural change may be readily incorporated as well in carriers 30, 130 and 230. The end flaps 542, 543 are foldably connected to the peripheral portions 438*a* of end panel 438 disposed on opposite sides of the top panel section 437*a* and extending divergently downwardly therefrom to the tuck flaps 450 connected to opposite upright peripheral portions of the end panel.

It will be noted in FIG. 26, that flaps 542, 543 are separated from the adjacent reinforcing member sections 440*b*, 441*b* by slits 560; however, the outer ends of the slits may terminate short of the outer edges of the blank and thus cause the reinforcing member sections and flaps to be interconnected by nubs N of material which are readily fractured when pressure is exerted between the adjacent section and flap. For example, when the reinforcing member sections are moved downwardly to a depending position between the end panels of the carrier, the nub N will tear thereby freeing the reinforcing member section and end flap from each other. Once the section has assumed its proper fold back under position, as seen in FIG. 27, the end flap 542 is folded inwardly so that it overlies the interior surface of the end panel 438 and thus produce the desired shadow box effect. In addition the folded end flap 542, 543 will retain the reinforcing member section in its folded back position.

Thus, it will be seen that a carrier has been provided which may be readily formed from a blank of sheet material having a simple, uncomplicated configuration and which may be readily set up and loaded by conventional highspeed packaging equipment. The carrier blank utilizes a minimal amount of sheet material and yet, notwithstanding this fact, has an esthetic appearance. The carrier is capable of accommodating a variety of articles, either filled or empty, and may be manually carried with comfort. Mutilation of the carrier is not required in order to remove the individual articles therefrom, when desired, and yet provides effective protection for the accommodated articles against accidental falling out of the carrier when the latter is subjected to normal handling.

I claim:

1. A carrier for foldable sheet material for accommodating a plurality of necked articles arranged in side-by-side relation to form at least one row, said carrier comprising an elongated base panel for subtending and supporting the row of accommodated articles and having opposed first peripheral portions and opposed second peripheral portions; end panels extending upwardly from said opposed first peripheral portions of said base panel, each end panel being positionable adjacent an end article of a row; an elongated top panel interconnecting the upper edge portions of the end panels and disposed in spaced substantially parallel relation with respect to said base panel, said top panel having spaced elongated peripheral portions with engaging means adapted to be in neck-engaging relation with the accommodated articles; upright elongated side panels extending upwardly a distance from said opposed second peripheral portions of said base panel for concealing substantial exterior portions of the accommodated articles, each side panel having an elongated upper edge spaced outwardly and downwardly from the neck-engaging peripheral portions of said top panel; means interconnecting adjacent edge portions of said end and side panels and affecting retention of said panels in predetermined upright angular relation; and a reinforcing member foldably connected to and depending from said top panel peripheral portions and being at least partially positioned under said top panel and intermediate said end panels, said reinforcing member coacting with said top and side panels to form elongated open side spaces for permitting selective axial removal of the articles from said carrier without permanent deformation to said top panel and said reinforcing member.

2. The carrier of claim 1 wherein the reinforcing member is adapted to resiliently engage the accommodated articles.

3. The carrier of claim 1 wherein the reinforcing member substantially spans the distance between said end panels and retains the latter in spaced substantially parallel relation.

4. The carrier of claim 1 wherein the reinforcing member includes a middle section substantially spanning the distance between the end panels, and flap sections foldably connected to opposite ends of said middle section and in engagement with the surfaces of said end panels positionable adjacent the end articles of a row.

5. A carrier of foldable sheet material for accommodating a plurality of necked articles arranged in a pair of parallel substantially coextensive rows; said carrier comprising an elongated base panel for subtending and supporting the rows of accommodated articles and having opposed first peripheral portions and opposed second peripheral portions; end panels extending upwardly from said opposed first peripheral portions of said base panel, each end panel being positionable adjacent the corresponding end articles of the rows; an elongated top panel interconnecting the upper edge portions of said end panels and disposed in spaced substantially parallel superposed relation with respect to said base panel, said top panel being substantially narrower than said base panel and having opposed elongated peripheral portions with engaging means adapted to be in neck-engaging relation with the accommodated articles of the rows; foldable side panels extending upwardly from said opposed second peripheral portions of said base panel, each side panel having an upper edge spaced outwardly and downwardly from an opposed elongated peripheral portion of said top panel; means interconnecting adjacent edge portions of said end and side panels and effecting retention of said panels in predetermined upright angular relation; and reinforcing members connected to and depending from said top panel and substantially spanning the distance between said end panels and retaining same in spaced upright relation, each reinforcing member being at least partially positioned under said top panel and being adapted to engage a row of accommodated articles at locations spaced inwardly from the opposed elongated peripheral portions of said top panel; said reinforcing members coacting with said top and side panels to form on opposite sides of said top panel elongated open side spaces for permitting selective axial removal of the articles from said carrier without permanent deformation to said top panel and said reinforcment members.

6. The carrier of claim 5 wherein the opposed elongated peripheral portions of said top panel are each provided with longitudinally spaced, open end neck-receiving slots forming said engaging means, and the reinforcing members connected to the opposed elongated peripheral portions are each provided with open end slots aligned with and communicating with corresponding slots formed in said top panel.

7. The carrier of claim 5 wherein the top panel is provided with a pair of longitudinally spaced finger holes, and at least a portion of said top panel intermediate said holes is of multiple thicknesses of the carrier sheet material.

8. The carrier of claim 7 wherein the top panel includes a pair of sections affixed to one another in overlapping relation, each section being foldably connected to the upper edge of an end panel, each overlapping section being provided with spaced openings, corresponding openings of said overlapping sections being aligned with one another and coacting to form the finger holes of said top panel.

9. The carrier of claim 8 wherein each reinforcing member includes a pair of sections affixed to one another in overlapping relation, each reinforcing member section being foldably connected to one of the overlapping sections forming the top panel.

10. The carrier of claim 5 wherein the reinforcing members are foldably connected to the opposed elongated peripheral portions of said top panel and are folded back under said top panel, a free edge portion of each reinforcing member being disposed beneath said top panel and positionable substantially between the rows of articles.

11. The carrier of claim 10 wherein the free edge portions of said reinforcing members engage one another.

12. The carrier of claim 5 wherein the reinforcing members are foldably connected to the opposed elongated peripheral portions of said top panel and are folded back under said top panel, said reinforcing members having segments thereof in interlocking relation, said reinforcing members coacting to form a hollow strutlike element centrally aligned and substantially coextensive with said top panel.

13. A carrier of foldable sheet material for accommodating a plurality of necked articles arranged in side-by-side relation to form at least one row, said carrier comprising a base panel for subtending and supporting the accommodated articles; end panels extending upwardly from opposed first peripheral portions of said base panel, each end panel being positionable adjacent an end article of a row; a top panel interconnecting the upper edge portions of the end panels and disposed in spaced substantially parallel relation with respect to said base panel, said top panel having spaced peripheral portions adapted to be in neck-engaging relation with the accommodated articles; upright side panels extending upwardly from opposed second peripheral portions of said base panel, each side panel having an upper edge spaced outwardly and downwardly from the neck-engaging peripheral portions of said top panel; means interconnecting adjacent edge portions of said end and side panels and effecting retention of said panels in predetermined upright angular relation; a reinforcing member connected to and depending from said top panel and being at least partially positioned under said top panel and intermediate said end panels; and a support member including a center section overlying said top panel, and side sections foldably connected to opposite sides of said center section and extending outwardly and downwardly from said top panel, each side section having a segment thereof affixed to the upper edge of a side panel.

14. The carrier of claim 13 wherein the top panel is elongated and provided with a pair of longitudinally spaced finger holes and the center section of the support member has a segment thereof disposed between the finger holes of said top panel.

15. The carrier of claim 14 wherein the center section of the support member is substantially coincident with said top panels, said center section being provided with first openings aligned with the finger holes of said top panel, and second openings through which the necked portions of the accommodated articles extend.

16. The carrier of claim 15 wherein the side sections of said support member are substantially coextensive with the center section and coact with the upright side panels to provide light shields for the accommodated articles.

17. The carrier of claim 16 wherein the second openings formed in the center section of the support member are aligned with foldlines connecting said center section and said side sections whereby a portion of each second opening extends into a side section.

18. A carrier of foldable sheet material for accommodating a plurality of necked articles arranged in a pair of parallel substantially coextensive rows; said carrier comprising an elongated base panel for subtending and supporting each row of articles and having opposed first peripheral portions and opposed second peripheral portions; end panels extending upwardly from said opposed first peripheral portions of said base panel, each end panel being positionable adjacent corresponding end articles of the rows; a top panel interconnecting upper edge portions of said end panels and disposed in spaced substantially parallel relation with said base panel, said top panel being narrower than said base panel and having elongated peripheral portions adapted to be disposed adjacent neck portions of the accommodated articles; side panels extending upwardly from said opposed elongated second peripheral portions of said base panel, each side panel being adapted to conceal substantial exterior portions of the articles of a row, the upper edge of each side panel being spaced outwardly and downwardly relative to an elongated peripheral portion of said top panel; means interconnecting adjacent edge portions of said end and side panels and effecting retention thereof in predetermined upright angular relation; reinforcing members connected to and depending from the elongated peripheral portions of said top panel and substantially spanning the distance between said end panels, each reinforcing member being at least partially positioned under said top panel and adapted to be disposed intermediate the rows of articles; and a support member including an elongated center section overlying said top panel, and side sections foldably connected to opposite elongated sides of said center section and extending outwardly and downwardly from said top panel, each side section having a segment thereof affixed to the upper edge of a corresponding side panel; said top panel and said support member side sections being adapted to coact and supportingly engage the neck portions of the accommodated articles.

19. The carrier of claim 18 wherein said support member side sections coact with said side, base, and end panels to effect substantial concealment of the accommodated articles.

* * * * *